US008844751B2

(12) United States Patent
Sakaguchi et al.

(10) Patent No.: US 8,844,751 B2
(45) Date of Patent: Sep. 30, 2014

(54) WASTE CONTAINER

(75) Inventors: Thomas Ray Sakaguchi, Brooklyn, NY (US); John Richard Omdahl, II, Lindon, UT (US); Tyler Fredric Allan, Springville, UT (US); Michael Saburo Horito, Provo, UT (US); Arthur Lee Dietrich-Croy, Salt Lake City, UT (US); Clark Evan Davis, Provo, UT (US); Mark Edwin Schulte, Orem, UT (US)

(73) Assignee: Pearhead, Inc., Brooklyn, NY (US)

( * ) Notice: Subject to any disclaimer, the term of this patent is extended or adjusted under 35 U.S.C. 154(b) by 0 days.

(21) Appl. No.: 13/239,579

(22) Filed: Sep. 22, 2011

(65) Prior Publication Data

US 2013/0075406 A1 Mar. 28, 2013

(51) Int. Cl.

| | |
|---|---|
| ***B65D 25/14*** | (2006.01) |
| ***B65F 1/06*** | (2006.01) |
| ***B65F 1/14*** | (2006.01) |

(52) U.S. Cl.

CPC ..... *B65F 1/06* (2013.01); *B65F 2230/134* (2013.01); *B65F 2240/132* (2013.01); *B65F 2250/112* (2013.01); *B65F 2240/164* (2013.01); *B65F 2230/00* (2013.01); *B65F 2250/114* (2013.01); *B65F 2250/11* (2013.01); *B65F 1/1607* (2013.01); *B65F 2250/111* (2013.01); *Y10S 220/908* (2013.01); *Y10S 220/9081* (2013.01)

USPC ..... 220/495.08; 220/253; 220/254.3; 220/254.6; 220/495.01; 220/495.05; 220/495.06; 220/495.11; 220/810; 220/908; 220/908.1

(58) Field of Classification Search

USPC ..... 220/230, 253, 254.1, 254.3, 254.5, 220/254.6, 254.9, 495.01, 495.05, 495.06, 220/495.11, 810, 908, 908.1

See application file for complete search history.

(56) References Cited

U.S. PATENT DOCUMENTS

| | | | | | |
|---|---|---|---|---|---|
| 4,127,212 | A * | 11/1978 | Waterbury | 220/255.1 |
| 4,753,367 | A * | 6/1988 | Miller et al. | 220/495.11 |
| 4,869,049 | A | 9/1989 | Richards et al. | |
| 5,082,132 | A * | 1/1992 | Tsai | 220/23.83 |
| 5,425,469 | A * | 6/1995 | Freedland | 220/495.11 |
| 5,462,189 | A * | 10/1995 | Pierce | 220/815 |
| 5,765,339 | A | 6/1998 | Garland | |
| 5,799,909 | A | 9/1998 | Ziegler | |
| 5,813,200 | A | 9/1998 | Jacoby et al. | |
| 6,170,240 | B1 | 1/2001 | Jacoby et al. | |
| 6,612,099 | B2 | 9/2003 | Stravitz | |
| 7,275,653 | B2 * | 10/2007 | Tedford, Jr. | 220/254.9 |
| 7,350,663 | B2 * | 4/2008 | Chomik et al. | 220/264 |
| 7,513,380 | B2 * | 4/2009 | Canedo | 220/230 |
| 2011/0170807 | A1 * | 7/2011 | Khubani | 383/81 |

* cited by examiner

*Primary Examiner* — Jeffrey Allen
*Assistant Examiner* — Madison L Poos
(74) *Attorney, Agent, or Firm* — Vista IP Law Group LLP

(57) ABSTRACT

A waste container for disposing sanitary waste, such as soiled diapers, comprises a canister having a storage space, an opening at an upper end and a bottom at a lower end. A retainer frame is pivotally attached to the canister and has an aperture for inserting a trash bag through the aperture and folding an upper edge of the trash bag over the retainer frame. A retainer is pivotally attached to the canister and has a rim that inserts into the aperture of the retainer frame to retain the trash bag. A lid having a hole which aligns with the aperture of the retainer frame is pivotally attached to the canister for allowing the lid to pivot between a closed position covering the opening and an open position. A sliding door is coupled to the lid and is slidable between a closed position and an open position.

20 Claims, 16 Drawing Sheets

WASTE CONTAINER

FIELD OF THE INVENTION

The field of the invention generally relates to waste disposal containers, like trash cans, and more particularly to a waste disposal container for disposing sanitary waste which minimizes odors inside the container from escaping to the outside of the container.

BACKGROUND OF THE INVENTION

A variety of waste containers for sanitary products, such as diapers, feminine hygiene products and the like, have been provided. Because such waste products are often wet and foul smelling, the containers typically accommodate a trash bag liner for holding the waste inserted into the waste container. The trash bag liner protects the container from being contaminated or soiled by the waste products.

A number of the previous waste containers also include designs to minimize the escape of odors from the waste products in the containers. Some designs have a length of flexible tubing that is twisted between each waste product to separately encapsulate each of the waste products. Other designs use a series of normally open and normally shut openings, or revolving doors to trap odors.

Several representative examples of waste containers may be found in U.S. Pat. Nos. 4,869,049; 6,170,240; 5,765,339; 5,799,909; 5,813,200; and 6,612,099; which provide further background for the invention.

SUMMARY OF THE INVENTION

The present invention is directed to an innovative waste container, which is especially well-suited for disposing sanitary waste such as diapers. The container is portable, easy to use, configured for use with a trash bag liner, and effective at preventing the escape of odors from within the container.

In one embodiment, the container comprises a canister defining a storage space and having an opening at an upper end and a bottom at a lower end. The lower end of the canister and/or bottom form a base upon which the container can stand. A retainer frame is movably coupled to the upper end of the canister. The retainer frame has a ring portion having an aperture for inserting a bag, such as a disposable trash bag or a reusable bag, through the opening and folding an upper edge of the trash bag over the retainer frame. The retainer frame is adjustable between a lowered position in which the retainer frame is positioned over the opening of the canister and a raised position in which the retainer frame is substantially out of the way of the opening of the canister.

In another aspect, the retainer frame may be pivotally attached to the canister for allowing the retainer frame to pivot between the lowered position in which the retainer frame is positioned over the opening of the canister and the raised position in which the retainer frame is substantially out of the way of the opening of the canister.

A retainer is movably coupled to the canister so that it sits above the retainer frame in their respective lowered positions. The retainer has a retention structure extending from the bottom side of the retainer that inserts into the aperture of the retainer frame. The retention structure is configured to avoid blocking the aperture of the retainer frame in the lowered position. For example, the retention structure may be a circular rim extending from the retainer which has a retainer hole that aligns with the aperture of the retainer frame. The retention structure is configured to retain the upper edge of the trash bag between the retention structure and the ring portion of the retainer frame. In other words, the trash bag is compressed between the retention structure and the inner surface of the ring to retain the trash bag.

In a further aspect, the retainer may be pivotally attached to the canister for allowing the retainer frame to pivot between a lowered position in which the retention structure is inserted into the aperture with the retainer frame in its lowered position, and a raised position in which the retainer is substantially out of the way of the opening of the canister.

A removable lid is coupled to the canister and is movable from a closed position in which the lid covers the opening in the canister, and an open position in which the opening is accessible. The lid has a hole which aligns with the aperture of the retainer frame when the lid is closed and the retainer frame is in its lowered position. In another aspect, the lid may be pivotally attached to the canister for allowing the lid to pivot between a closed position in which the lid covers the opening, and an open position in which the opening is accessible.

A sliding door is coupled to the lid over the hole in the lid. The sliding door is slidable between a closed position in which the sliding door covers the hole in the lid and an open position in which the hole is accessible to insert an item of waste through the hole in the lid.

Use of the waste container is relatively straightforward. First, in order to install a trash bag (or reusable bag, as the case may be), the lid and retainer are placed in their raised positions out of the way of the opening in the canister. The trash bag is then placed through the aperture in the retainer frame with the upper edge of the trash bag folded over the top of the retainer frame and the lower part of the trash bag loosely within the storage space of the canister. The retainer is then lowered onto the retainer frame such that the retention structure inserts into the aperture of the retainer frame thereby retaining the trash bag. The lid is then moved into the closed position over the opening in the canister. In order to dispose of a waste product, the sliding door is slid to the open position. The waste product is inserted through the hole in the lid and then the waste product falls, or may be pushed, through the aperture in the retainer frame into the trash bag within the storage space. Finally, the sliding door is slid back to the closed position, thereby sealing the storage space. Once the trash bag is full, the lid, retainer and retainer frame are moved to their open positions out of the way of the opening in the canister. This releases the upper edge of the trash bag from between the retention device and the retainer frame. The trash bag can then be removed, tied closed, and disposed. The waste container is now ready for another trash bag.

In another aspect of the invention, an elastomeric seal may be provided between the lid and the canister, and another elastomeric seal between the sliding door and the lid, to provide a reasonably airtight seal within the storage space of the canister. This seal helps prevent odors from escaping the container.

In still another aspect of the invention, a biasing device is provided to bias the sliding door against the elastomeric seal between the sliding door and the lid. The biasing device may be configured to release when the sliding door is in the open position, and to engage when the door is in the closed position.

In still another aspect of the present invention, the retainer frame, retainer and lid may be pivotally attached to the canister using a plurality of hinges.

Accordingly, an easy to use, and effective waste container is provided. Although it is particularly useful for sanitary waste such as diapers and used hygienic products, it can also be used with any other type of garbage. For instance, the container can be used as a diaper pail, a general garbage can, a dustbin, or the like.

BRIEF DESCRIPTION OF THE DRAWINGS

The invention is illustrated by way of example and not limitation in the figures of the accompanying drawings, in which like reference numbers refer to similar elements, and in which.

DETAILED DESCRIPTION OF THE INVENTION

Figure 1:
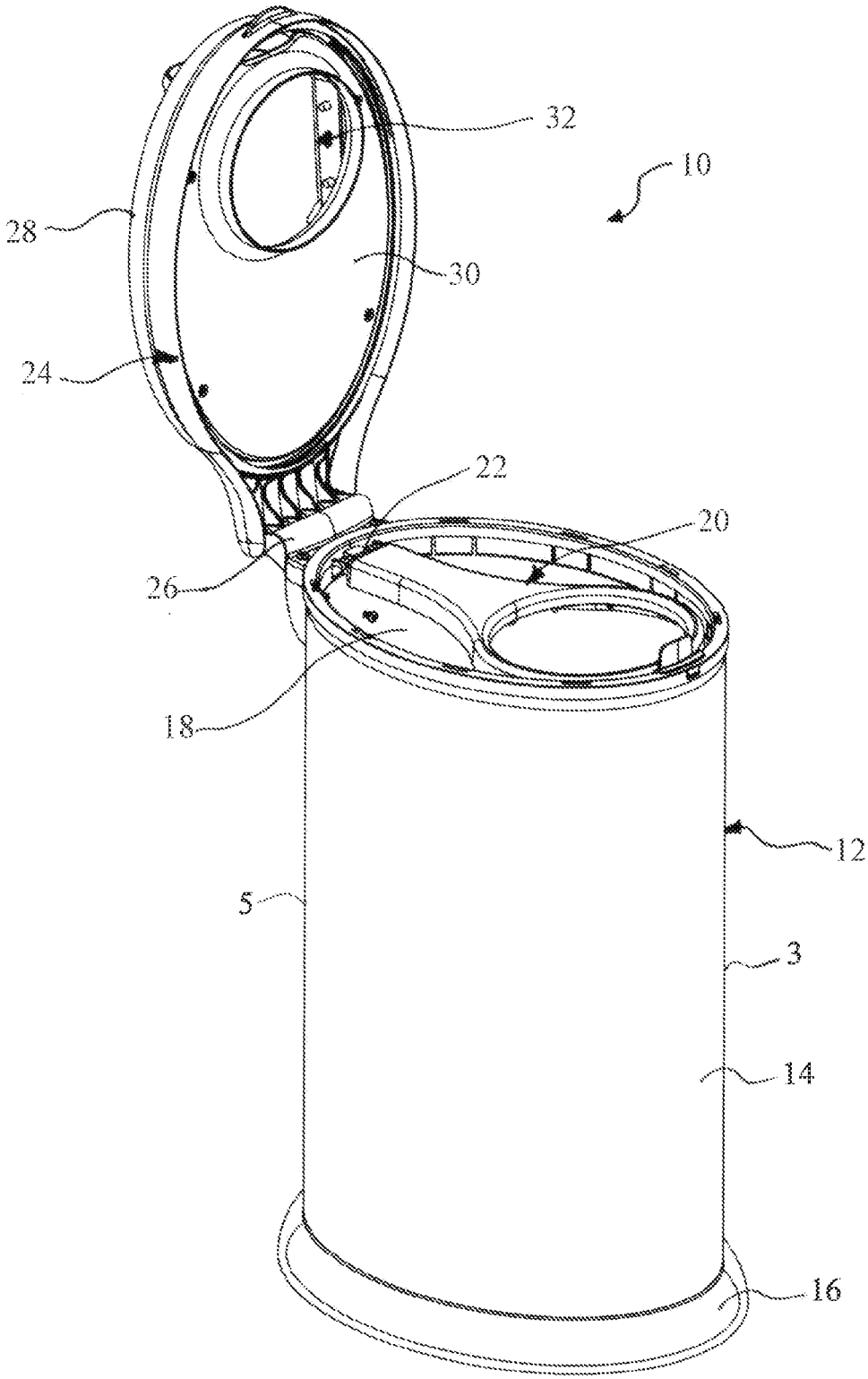
FIG. 1 is a front perspective view of a waste container according to one embodiment of the present invention, with the lid open and the retainer frame in the lowered position.

Referring to FIGS. 1-4, a waste container 10 according to one embodiment of the present invention is shown. The waste container 10 comprises a canister 12 having a generally cylindrical shaped sidewall 14, a bottom 16 at its lower end, and an opening 18 at its upper end. While the canister 12 shown in the described embodiment has an elliptical or oval cylinder shape, i.e. an elliptical or oval cross-section, the canister 12 can be any suitable shape, such as a circular cylinder, polygonal cylinder (sometimes referred to as a prism shape), or even an irregular shape. The canister 12 defines an interior within the sidewall 14. The canister may be formed from a metal material such as steel, aluminum, or other suitable metal, in order to minimize the absorption of odors. Alternatively, the canister may be formed of any suitable polymer material, such as plastic, or any suitable combination of metals and polymers.

Figure 2:
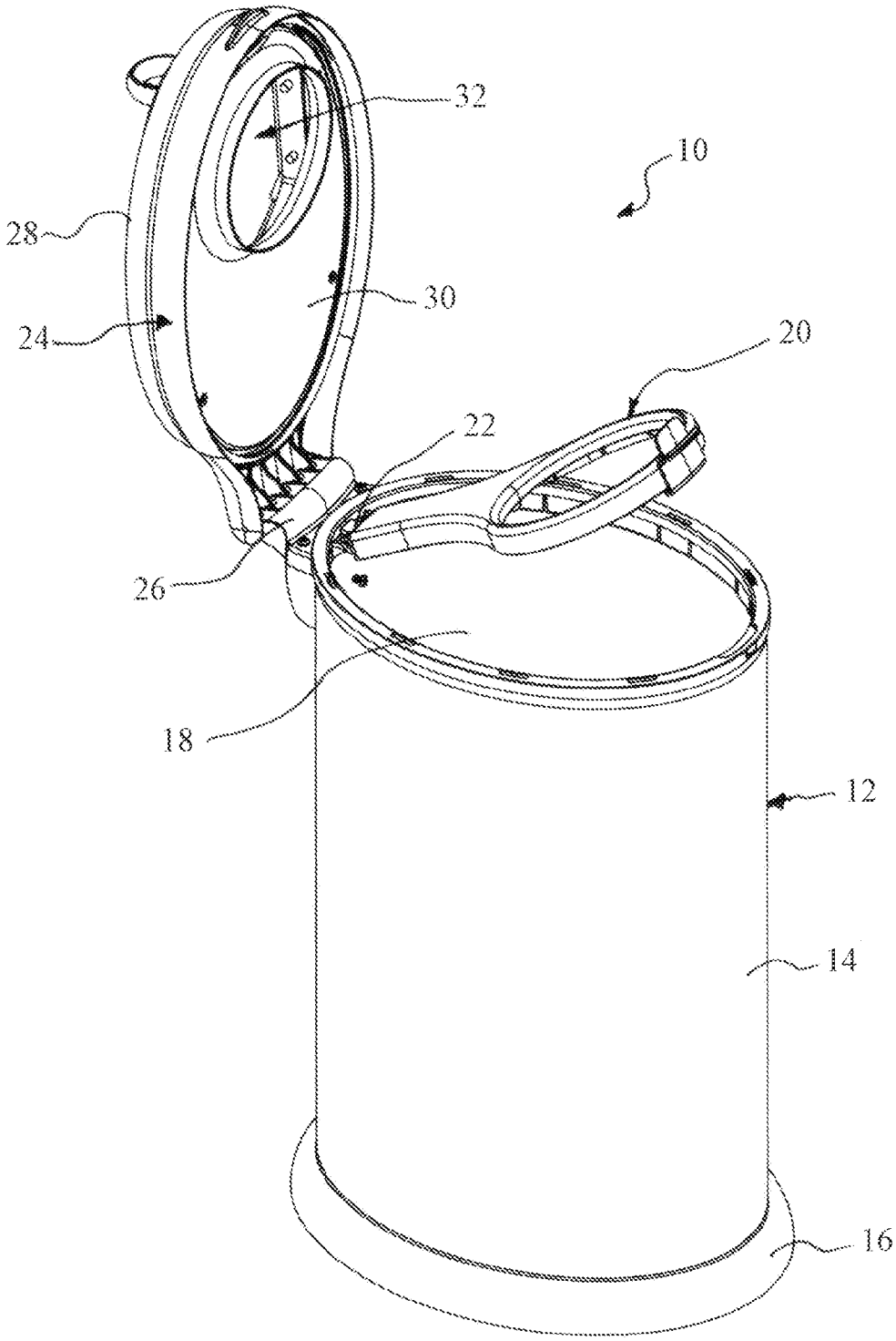
FIG. 2 is a front perspective view of a waste container according to one embodiment of the present invention, with the lid open and the retainer frame in the partially raised position.

A retainer frame 20 is pivotally attached to the canister 12 near the upper edge of the canister 12 by a first hinge 22. FIG. 1 shows the retainer frame 20 in the lowered position over the opening 18 of the canister 12, while FIG. 2 shows the retainer frame 20 being pivoted upward towards its raised position. The retainer frame 20 can be pivoted about the first hinge 22 to a vertical position, or slightly past the vertical position, in its fully raised position where the retainer frame 20 is substantially out of the way of the opening 18.

Figure 3:
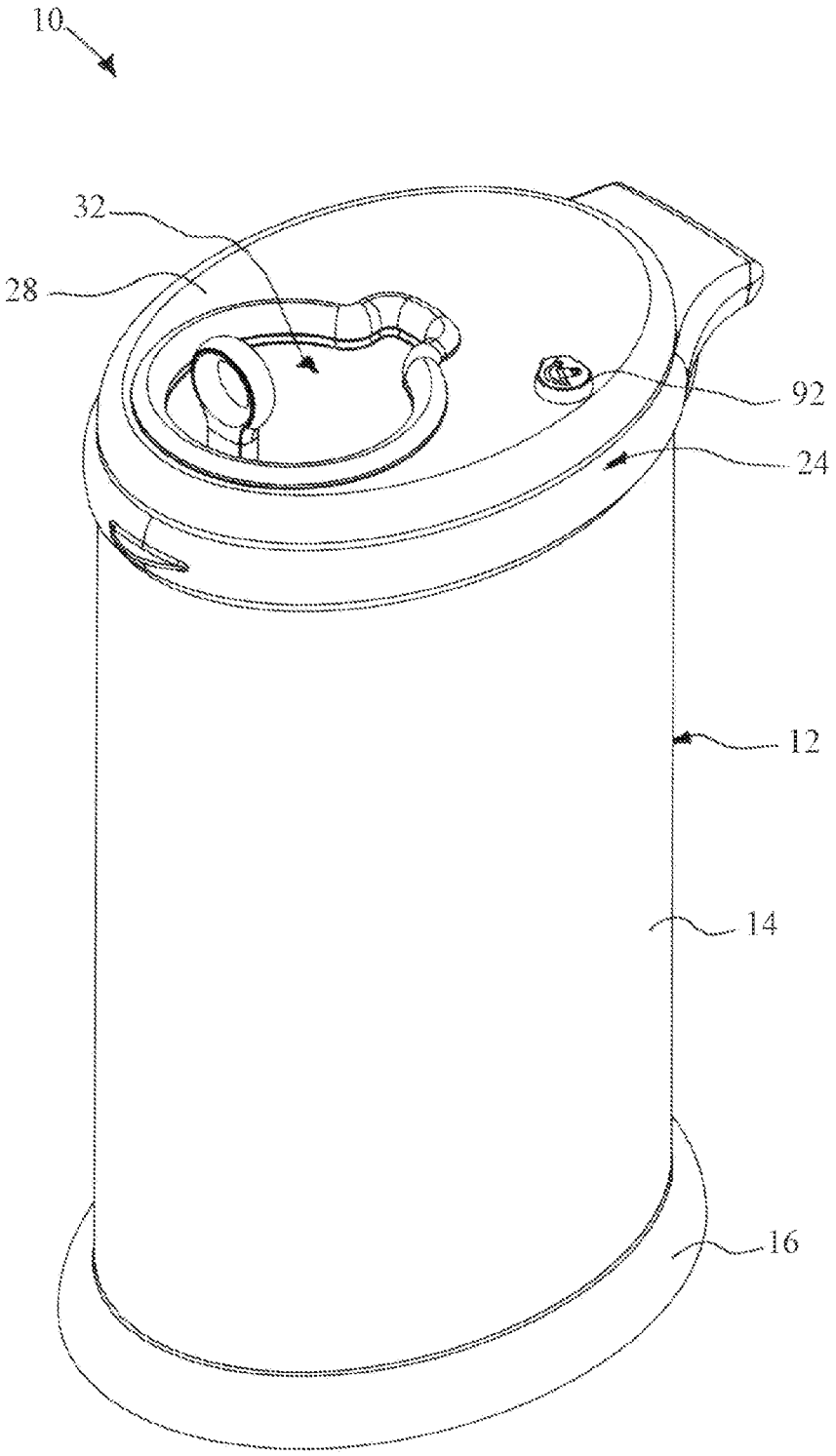
FIG. 3 is a front perspective view of the waste container of FIG. 1, with the lid closed.
Figure 4:
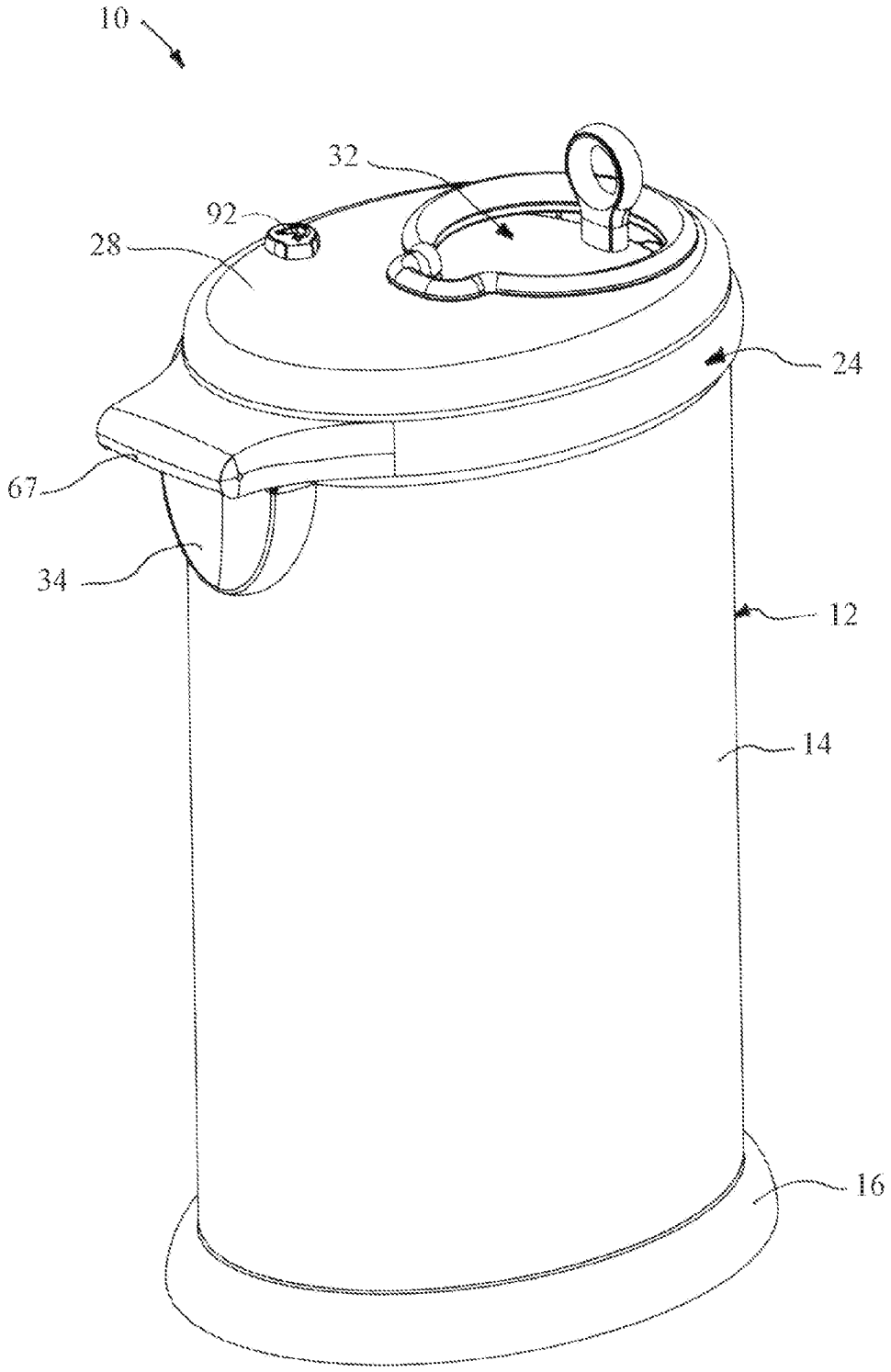
FIG. 4 is rear perspective view of the waste container of FIG. 1 with the lid closed.

A lid assembly 24 is also pivotally attached to the canister 12 by a second hinge 26. The lid assembly 24 includes a lid body 28, a retainer 30 and a sliding door assembly 32. FIGS. 1-2 show the lid assembly 24 in the open position in which the lid assembly is removed from the opening 18. FIGS. 3-4 show the lid assembly 24 in the closed position with the lid assembly 24 pivoted about the second hinge 26 to cover the opening 18, thereby closing the storage space within the canister 12.

As best shown in the rear perspective view of FIG. 4, a support block 34 is also attached to the canister 12 at the rear side of the canister 12. The support block 34 may be attached to the canister 12 by one or more screws or other suitable fasteners. The lid assembly 24 attaches to the support block 34, as well as the upper end of the canister 12 in order to provide further support for the lid assembly 24.

Figure 5:
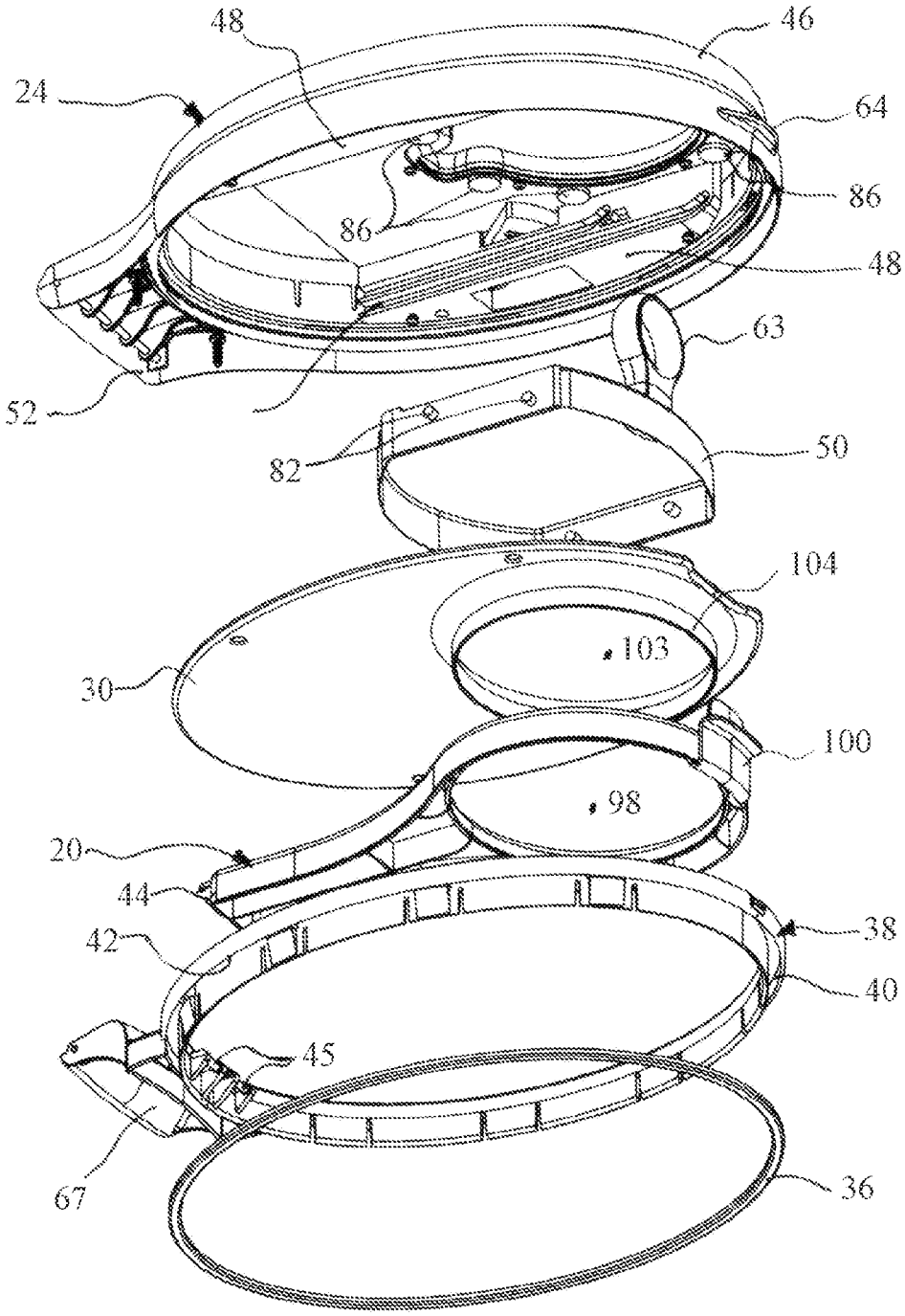
FIG. 5 is an enlarged, exploded perspective view of the lid assembly, the sliding door assembly, and the retainer of the waste container of FIG. 1.

Turning to FIG. 5, an exploded view of the lid assembly 24, sliding door assembly 32, retainer 30, and retainer frame 20 is shown. At the bottom of the exploded view is a seal 36 which is disposed between the bottom portion (the canister cap 40) of the hinged support frame 38 (see FIG. 9) and the top edge of the canister 12. The seal 36 may be elastomeric or other suitable material. The seal 36 may have a "U" shape to securely rest on the top edge of the canister 12. The seal 36 also fits into a channel 42 of the canister cap 40 of the hinged support frame 38. The canister cap 40, as described in more detail below, attaches to the top edge of the canister 12, with the top edge inserting into the channel 42 of the canister cap, thereby compressing the seal 36 between the top edge and the channel 42.

Moving up the exploded view of FIG. 5, the retainer frame 20 is pivotally attached to the canister cap 40 using the first hinge 22. The hinge 22 comprises a pair of connectors 44 on the retainer frame 20 which rotatably couple to a pair of rods 45 on the canister cap 40 such that the retainer frame 20 pivots about the first hinge 22.

The elements above the retainer frame 20 in FIG. 5 are all part of the lid assembly 24 and the sliding door assembly 32. The main structural part of the lid assembly 24 is the cover 46 (also referred to as main body 28). The retainer 30 is affixed to the cover 46 by fastening the retainer 30 to the sliding door support 48 of the sliding door assembly 32, such as using screws 78 (see FIG. 6B). This may be done using any suitable means, such as fasteners like screws, adhesive, sonic welding, etc.

Next, the sliding door 50 of the sliding door assembly 32 is above the retainer 30. As described in more detail below, the sliding door 50 has four pins 82 which ride in channels 54 of the sliding door support 48. Above the sliding door 50 is the lid rim 52, which is the other main part of the hinged support frame 38.

Figure 6A:
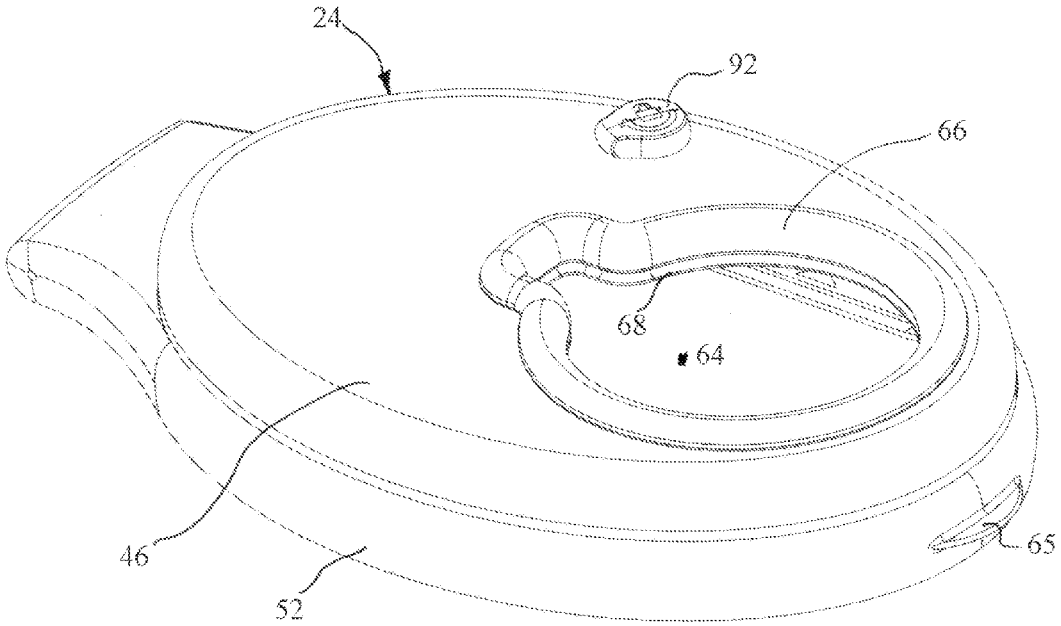
FIG. 6A is an enlarged, perspective, top view of the lid assembly of the waste container of FIG. 1.
Figure 6B:
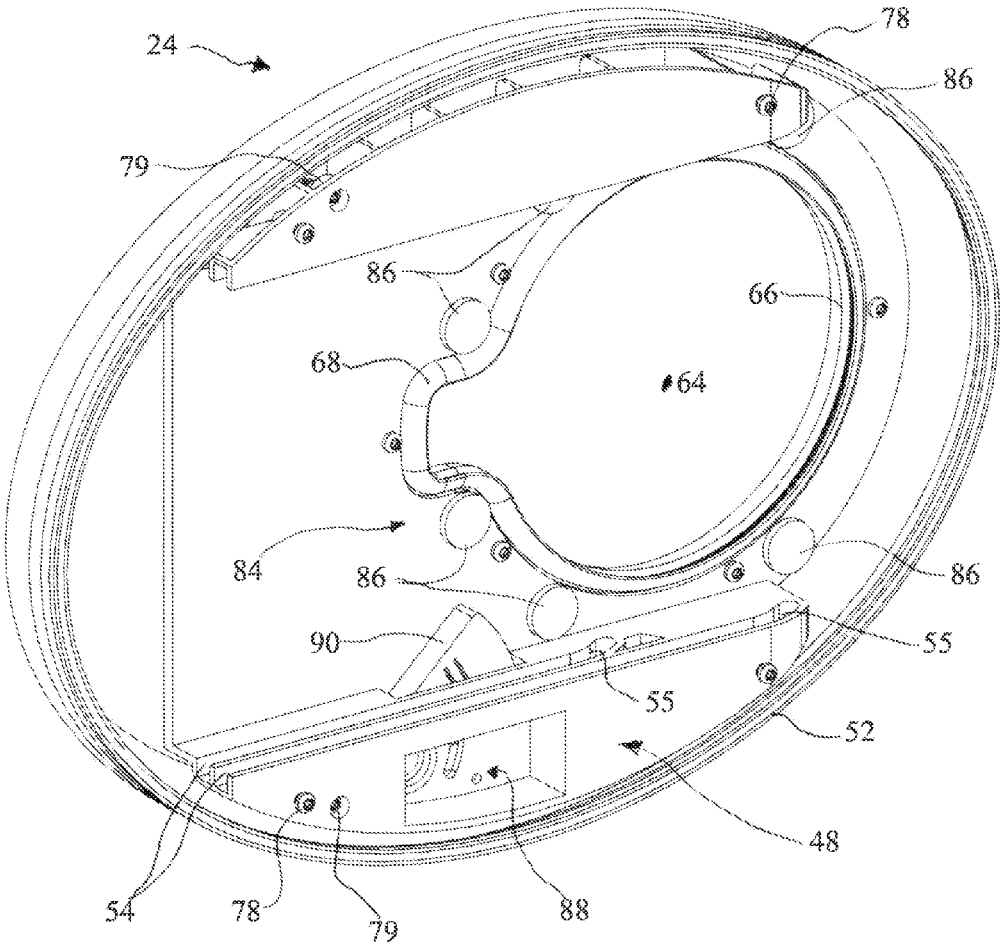
FIG. 6B is an enlarged, perspective, bottom view of the lid assembly of the waste container of FIG. 1.

The lid assembly 24 will now be described in more detail with reference to FIGS. 6A, 6B and 9. The lid assembly 24 comprises a cover 46 which may be formed from a metal material such as steel, aluminum, or other suitable metal, in order to minimize the absorption of odors. Alternatively, the cover 46 may be formed of any suitable polymer material, such as plastic, or any suitable combination of metals and polymers. The cover 46 is attached to the lid rim 52 which is the top part of the hinged support frame 38 (shown in FIG. 9). The cover 46 has a hole 64 which has a keyhole type shape which accommodates the sliding door 50 and its handle 63. A grommet 66 may be provided around the outline of the hole 64 to provide a lining around the edge of the hole 64. The grommet 66 may have a raised ridge portion on the outer surface of the cover 46 around the perimeter of the hole 64, and an interior portion lining the inside surface of the hole. The grommet 66 may also be used to secure a door seal 68 on the inside surface of the cover 46 around the perimeter of the hole 64. The door seal 68 seals against the top surface 70 of the sliding door 50 (see FIG. 7A), at least when the sliding door 50 is in the closed position over the hole 64. A lid locking device may be provided to lock the lid assembly 32 in the closed position, and which can be unlocked to allow the lid assembly 32 to be opened.

Figure 9:
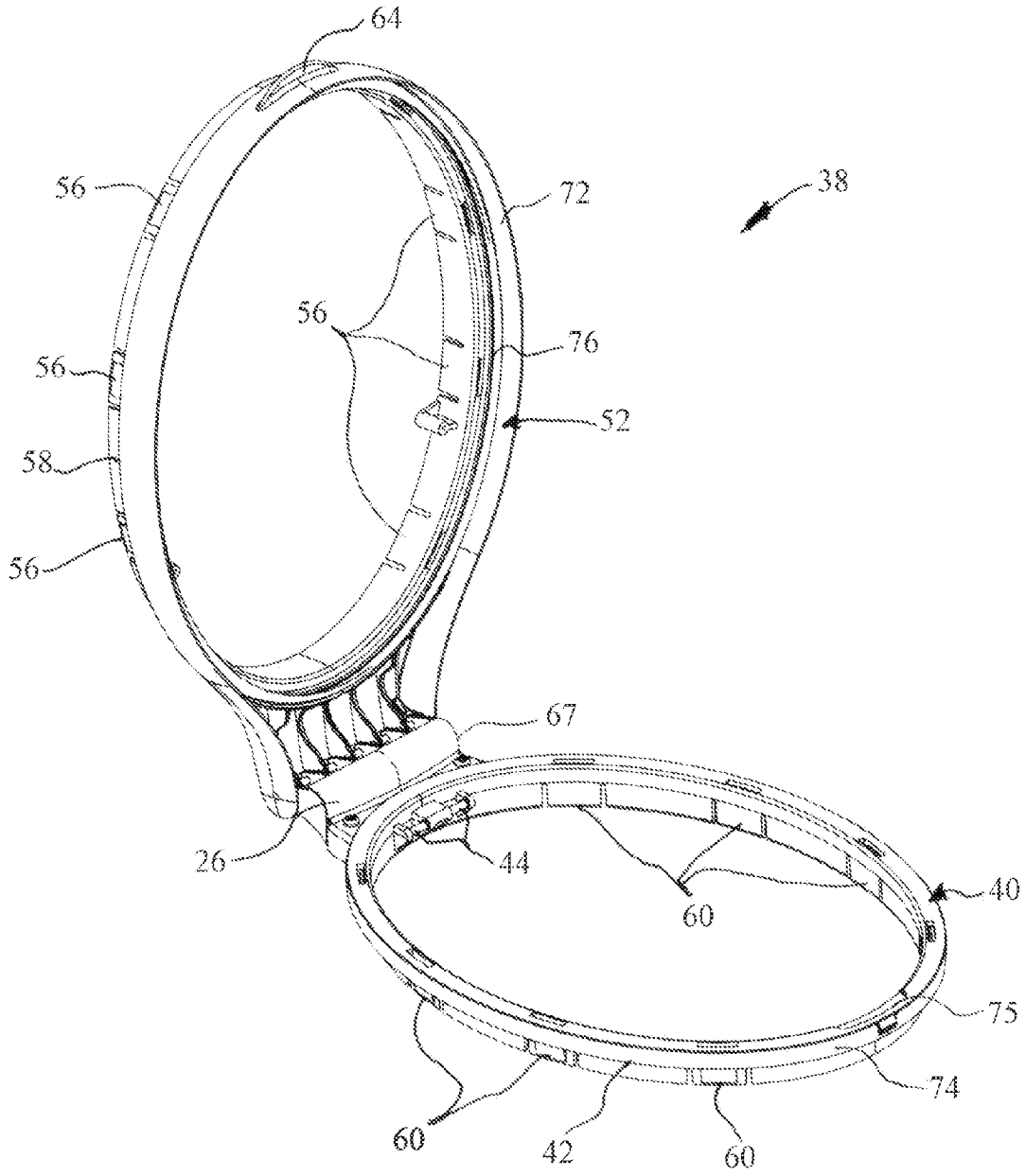
FIG. 9 is an enlarged, perspective view of the hinged support frame of the waste container of FIG. 1.

As better shown in FIG. 9, the hinged support frame 38 comprises the canister cap 40 and the lid rim 52. The canister cap 40 is pivotally attached to the lid rim 52 by the second hinge 26. The lid rim 52 is a frame having the same basic shape as the cross-section of the canister 12, such that it fits firmly onto the canister cap 40. The lid rim 52 has a plurality of clips 56 spaced around the perimeter of the lid rim 52 and a groove 58 extending entirely around the perimeter of the lid rim 52. The lower edge of the cover 46 inserts into the groove 58 and the clips 56 clip onto a lip around the lower edge of the cover 46 to securely retain the cover 46 onto the lid rim 52. The lid rim 52 has a small handle 65 for pivoting the lid assembly 24 between the open and closed positions. The canister cap 40 has a built in handle 67 (also shown in FIGS. 4-5), which can be used to pick up and carry the entire waste container 10.

The canister cap 40 is also a frame having the same basic shape as the cross-section of the canister 12, such that it fits firmly onto the top edge of the canister 12. The canister cap 40 has a plurality of clips 60 spaced around the perimeter of the canister cap 40 and a channel 42 extending entirely around the perimeter of the canister cap 40. The upper edge of the canister 12 inserts into the channel 42 and the clips 60 clip onto a lip around the upper edge of the canister 12 to securely retain the canister cap 40 onto the canister 12. The outer ring 72 of the lid rim 52 fits over the outer ring 74 of the canister cap 40. A seal 76, which may be an elastomeric seal, may be provided around the interface between the canister cap 40 and the lid rim 52 to seal this interface. The canister cap 40 also has a clip recess 75 for receiving a bag retainer clip/handle 100 of the retainer frame 20 when the retainer frame 20 is in its lowered position onto the canister cap 40.

Turning back to FIGS. 6A and 6B, the sliding door assembly 32 comprises the sliding door 50, and the sliding door support 48. As shown in FIG. 6B, the sliding door support 48 is attached to the lid assembly 24 using a plurality of screws 79. The sliding door support 48 has four opposing guide channels 54 which support the sliding door 50, and guide the sliding movement of the sliding door 50. FIG. 6B shows two of the channels 54 on one side of the hole 64, namely an upper guide channel 54 and a lower guide channel 54. There are two more channels 54, another upper guide channel 54 and another lower guide channel 54, symmetrically disposed on the other side of the hole 64, as shown in FIG. 5. The rear portion of the channels 54 are aligned in a direction substantially parallel to the plane of the hole 64. Then, there is a bend at the proximal end of each channel 54 leading to a front channel portion 55 which extends in a direction toward the plane of the hole 64. As used herein, the terms "proximal" and "distal" refer to positions relative to the front 3 and rear 5 (see FIG. 1) of the waste container 10, with proximal being closer to the front 3 and distal being further from the front or closer to the rear 5, as the case may be.

Figure 7A:
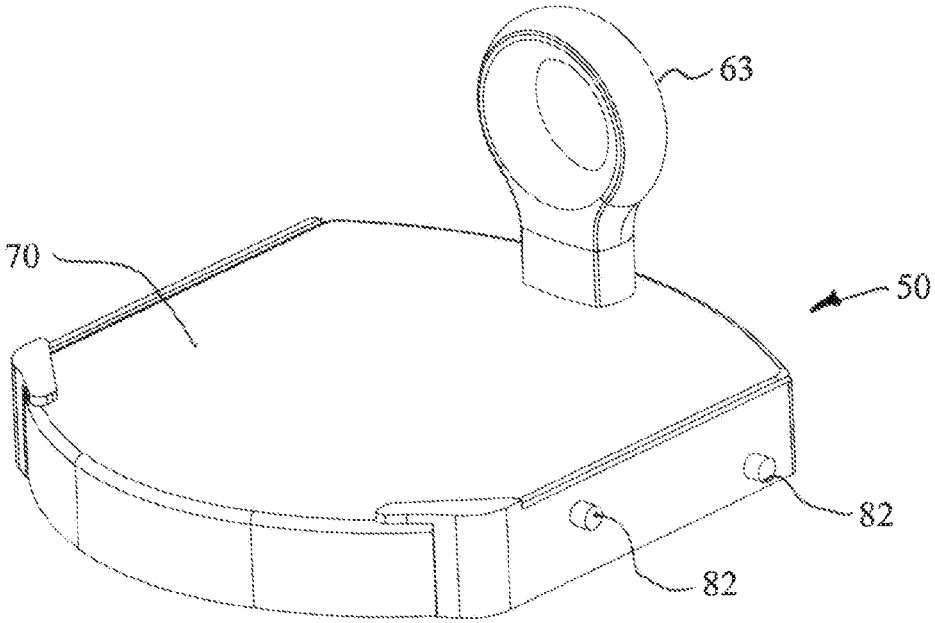
FIG. 7A is an enlarged, perspective, top view of the sliding door of the waste container of FIG. 1.
Figure 7B:
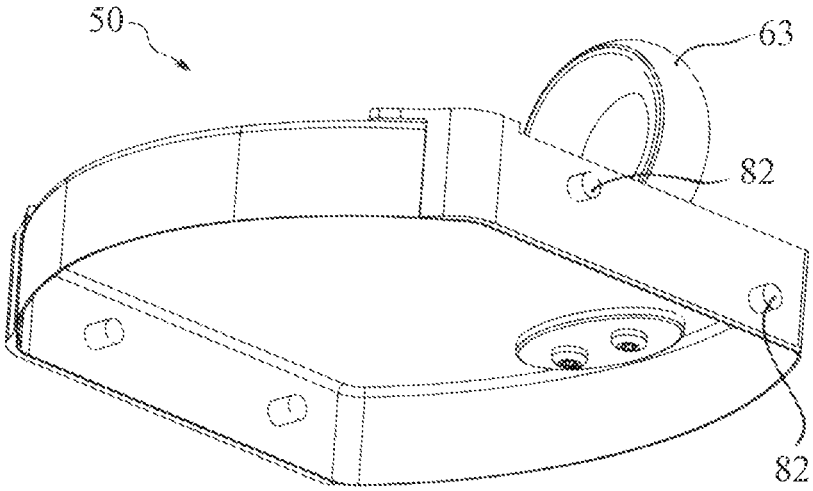
FIG. 7B is an enlarged, perspective, bottom view of the sliding door of the waste container of FIG. 1.

As shown in FIGS. 5, 7A and 7B, the sliding door 50 has four guide pins 82, in which one of the guide pins 82 is slidably received in each of the four guide channels 54. Thus, the sliding door 50 slides back and forth between a closed position in which the door 50 is slid forward such that the sliding door 50 completely covers the hole 64, and an open position in which the door 50 is slid rearward thereby making the hole 64 accessible. The movement of the sliding door 50 is determined by the path of the channels 54. As the sliding door 50 is moved forward from the fully open position (distal position), the sliding door 50 moves in a first direction substantially parallel to the plane of the hole 64 until each of the guide pins 82 reaches the bend and the front channel portion 55. At this point, the sliding door 50 continues to slide forward toward the closed position, but also moves upward, in a direction transverse to the first direction, toward the seal 68 and the plane of the hole 64. This upward movement caused by the front channel portion 55 of the guide channels 54 causes the top surface 70 of the sliding door 50 to come into contact with, and press against the seal 68. Going in the opposite direction from the open position, as the sliding door 50 is closed, the front channel portion 55 moves the sliding door 50 rearward and downward away from the seal 68, such that the seal 68 does not unduly hinder the sliding movement of the sliding door 50. The sliding door 50 may move downward such that the top surface 70 is completely out of contact with the seal 68, or so that it bears against the seal 68 only lightly, so that it does not cause significant friction on the sliding of the door 50.

In addition, the sliding door assembly 32 may have a biasing device 84 which biases the sliding door 50 against the seal 68, and also assists in holding the door 50 in the closed position. The biasing device 84 may comprise a plurality of magnets 86 arranged around the perimeter of the hole 64. The sliding door 50 may be made of a material attracted to magnets, such as steel, or the sliding door 50 may be provided with magnets around its perimeter wherein the location of the magnets matches the magnets 86 when the door 50 is in the closed position. The magnets 86 make for an excellent biasing device 84 because the force of the magnets only becomes effective as the sliding door 50 comes into close proximity to the magnets 86, whereas when the door 50 is separated by even a small distance from the magnets, the magnets produce only a negligible force on the door 50.

The sliding door assembly 32 also includes a locking device 88 for locking the sliding door 50 in the closed position. The locking device 88 has a rotating block 90 disposed on the inside of the cover 46. The block 90 is rotatable from a locked position in which it blocks the sliding door 50 from moving from the closed position to the open position, to an unlocked position in which the block 90 does not block the sliding door 50 from moving from the closed position to the open position. The block 90 is coupled to a locking knob 92 disposed on the outside surface of the cover 46. The knob 92 can be turned to rotate the block 90 between the locked and unlocked positions. Preferably, the locking device 88 has some degree of baby-proofing that makes it relatively difficult for a baby to open the sliding door 50.

Referring now to FIGS. 7A and 7B, the sliding door 50 has a generally four sided shape, with two opposing straight sides, and a curved front side and a curved rear side. The sliding door 50 has a substantially flat top surface 70 and four sidewalls extending downward from the top surface 70. The straight sidewalls are provided with the guide pins 82, two guide pins 82 on each straight sidewall. The guide pins 82 on a straight sidewall are vertically offset so that one guide pin 82 is received in the top guide channel 54, and the other guide pin 82 is received in the bottom guide channel 54. The handle 63 is attached to the top surface 70, such that the handle 63 extends through the hole 64 to the outside of the cover 46, with the top surface 70 and the remainder of the sliding door 50 inside of the cover 46.

Figure 8A:
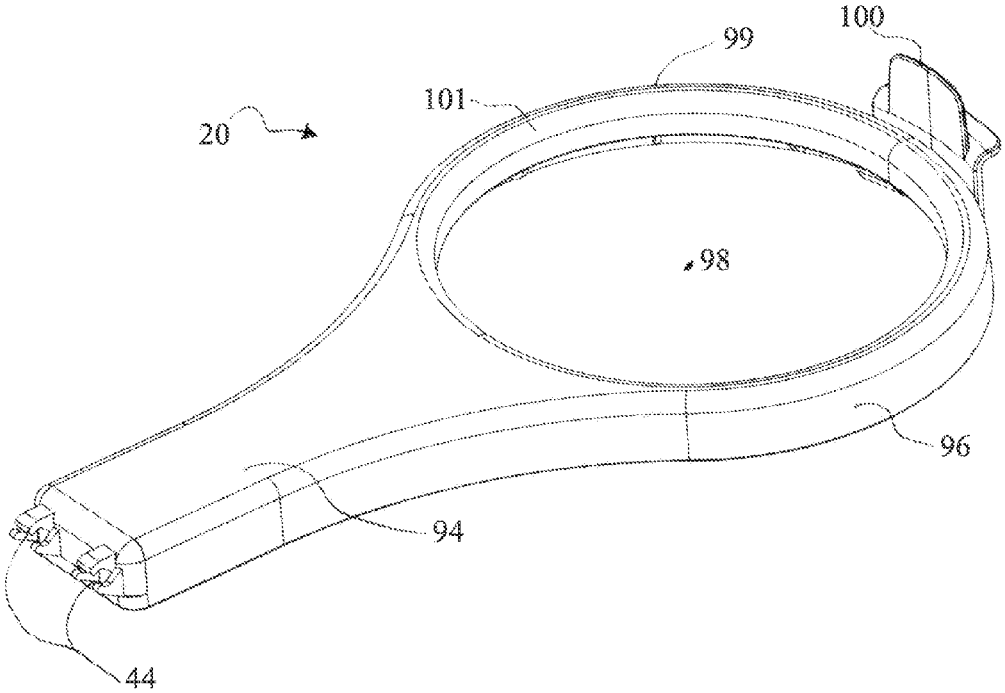
FIG. 8A is an enlarged, perspective, top view of the retainer frame of the waste container of FIG. 1.
Figure 8B:
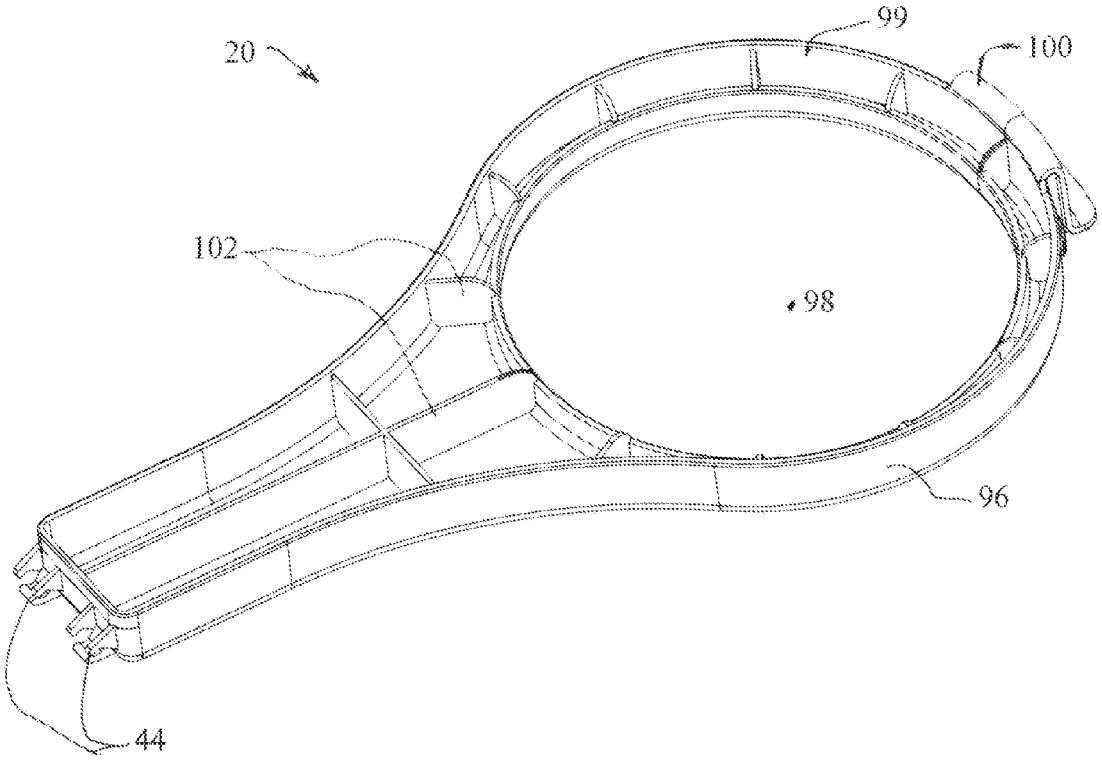
FIG. 8B is an enlarged, perspective, bottom view of the retainer frame of the waste container of FIG. 1.

Turning to FIGS. 8A and 8B, the retainer frame 20 comprises a distal arm portion 94 connected to a proximal ring portion 96. The distal end of the arm portion 94 has the two hinge connectors 44 which rotatably couple to the pair of rods 45 on the canister cap 40 such that the retainer frame 20 pivots about the first hinge 22 (see FIGS. 1-4). The ring portion 96 has an outer ring 99 forming an aperture 98 within the ring 99. The ring 99 and aperture 98 are shown having an oval shape with the major axis (larger diameter) being transverse to the axis from distal end to proximal end of the retainer frame 20, and a minor axis (smaller diameter) along the axis from distal end to proximal end of the retainer frame 20. It should be understood that the ring 99 and aperture 98 may have other suitable shapes, such as a circle, a polygon, or other shape. The ring 99 has a lead-in chamfer 101 which helps guide the retainer rim 104 of the retainer 30 into the aperture 98 when the retainer 30 is lowered onto the retainer frame 20, as described in more detail below. The ring 99 and aperture 98 are sized to allow a bag, such as a disposable trash bag or a reusable bag, to be inserted through the aperture 98 and the upper edge of the bag to be folded over the top surface of the retainer frame 20 (see FIG. 11).

The retainer frame 20 also has a bag retainer clip/handle 100 at the proximal end of the ring 99. The bag retainer clip/handle 100 has a slot for receiving and holding a bag installed on the retainer frame 20 (see FIG. 11) and a small handle for raising and lowering the retainer frame 20. As shown in FIG. 8B, the retainer frame 20 may have a plurality of ribs 102 for increasing the stiffness and strength of the retainer frame 20.

Figure 10A:
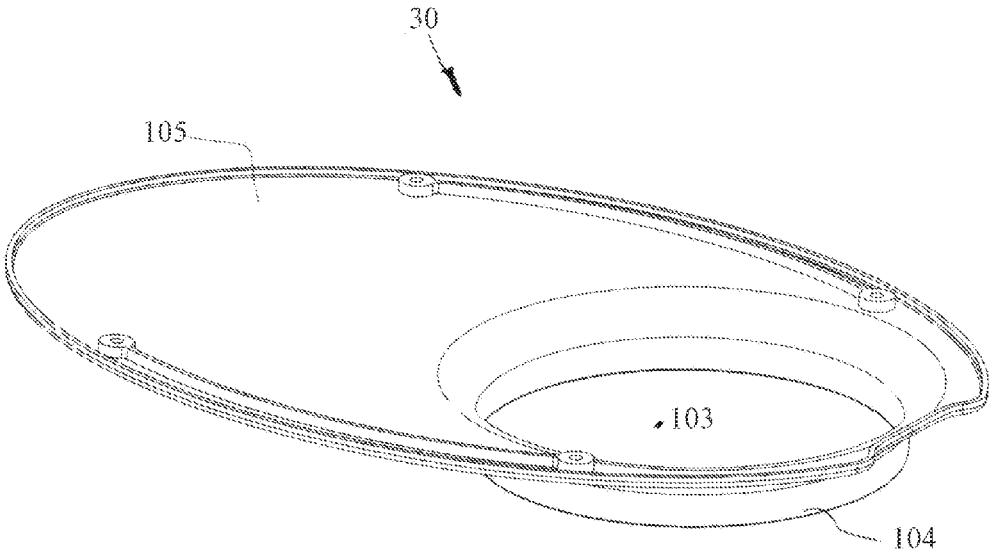
FIG. 10A is an enlarged, perspective, top view of the retainer of the waste container of FIG. 1.
Figure 10B:
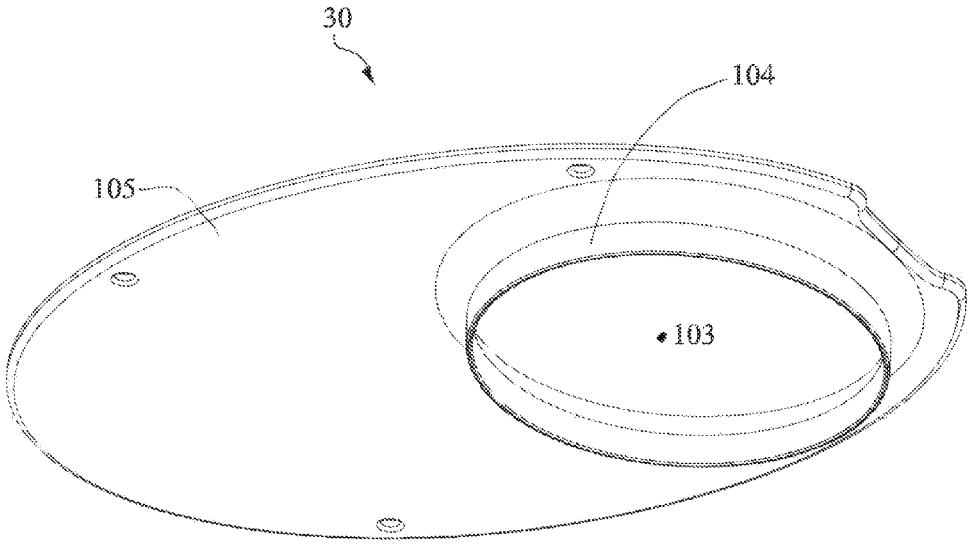
FIG. 10B is an enlarged, perspective, bottom view of the retainer of the waste container of FIG. 1.

Referring now to FIGS. 10A and 10B, the retainer 30 has a main body 105 comprising a substantially flat plate having the same general shape as the cross-section of the canister 12. The main body 105 has a retainer hole 103. A circular retainer rim 104 extends from the bottom side of the main body 105 around the perimeter of the retainer hole 103. The rim 104 has the same shape as the hole 98 in the retainer frame 20. The outside perimeter of the rim 104 is slightly smaller than the inside perimeter of the hole 98 so that the rim 104 inserts into hole 98 when the retainer 30 and retainer frame 20 are in their respective lowered positions. As described above, the retainer 30 is attached to the cover 46 by fastening the retainer 30 to the sliding door support 48 of the sliding door assembly 32.The screws 78 pass through the screw holes shown in the main body 105 of the retainer 30. Thus, the retainer 30 is pivotable, along with the lid assembly 24, between a raised position in which the retainer is out of the way of the opening 18 and a lowered position in which the retainer 30 is directly over the retainer frame 20 and the retention rim 104 is inserted into the aperture 98 of the retainer frame 20. Accordingly, with the lid assembly 24, retainer frame 30 and retainer 20 in their closed and/or lowered positions, the hole 64, the aperture 98 and the retainer hole 103 are all aligned so that a waste product can be inserted into a bag installed on the retainer frame 20 and retainer 30 and positioned within the storage space, or directly into the storage space (in the case that no bag is used).

Figure 11:
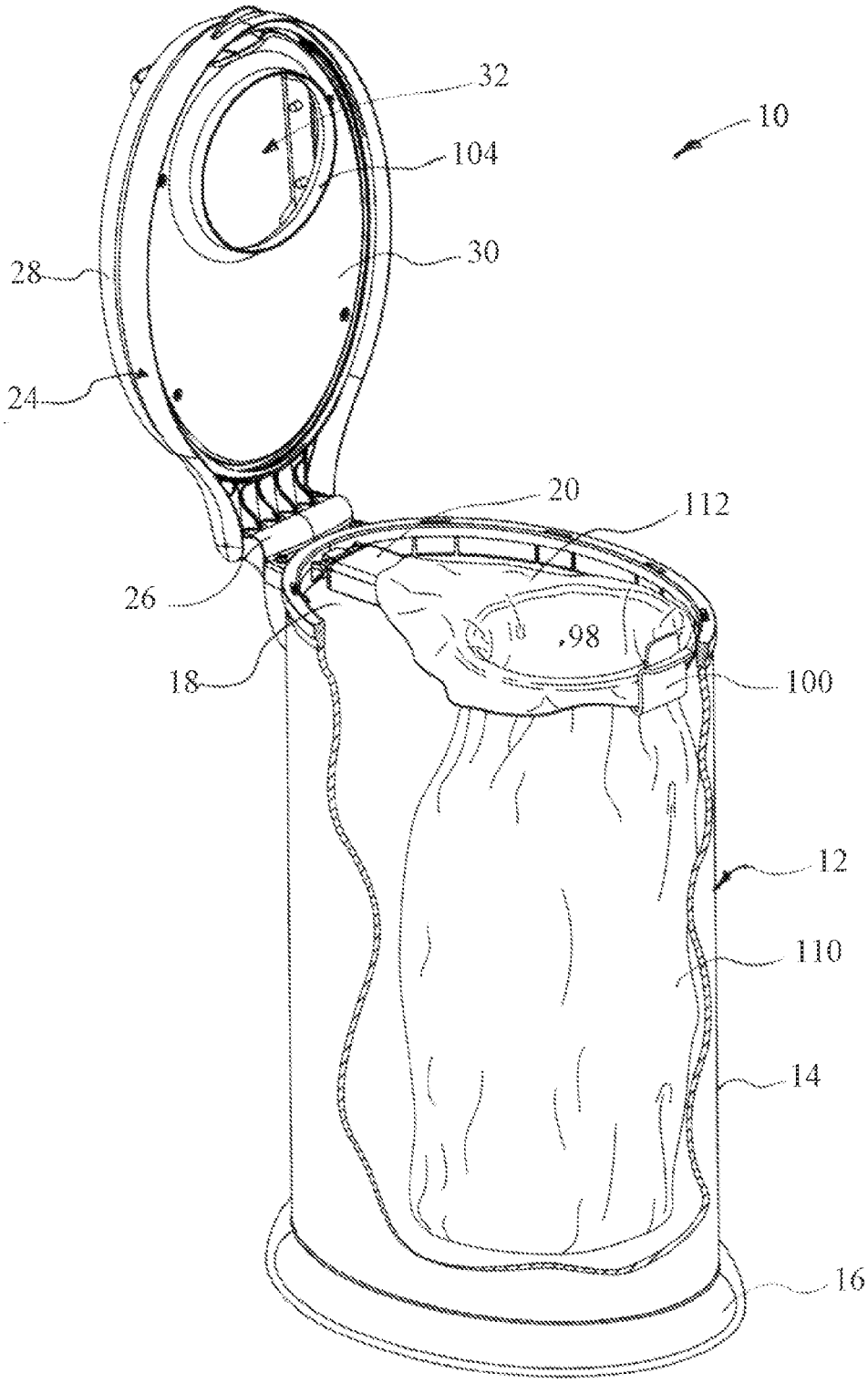
FIG. 11 is a front, perspective, cutaway view of the waste container of FIG. 1 with the lid open and a bag inserted into the waste container.
Figure 12:
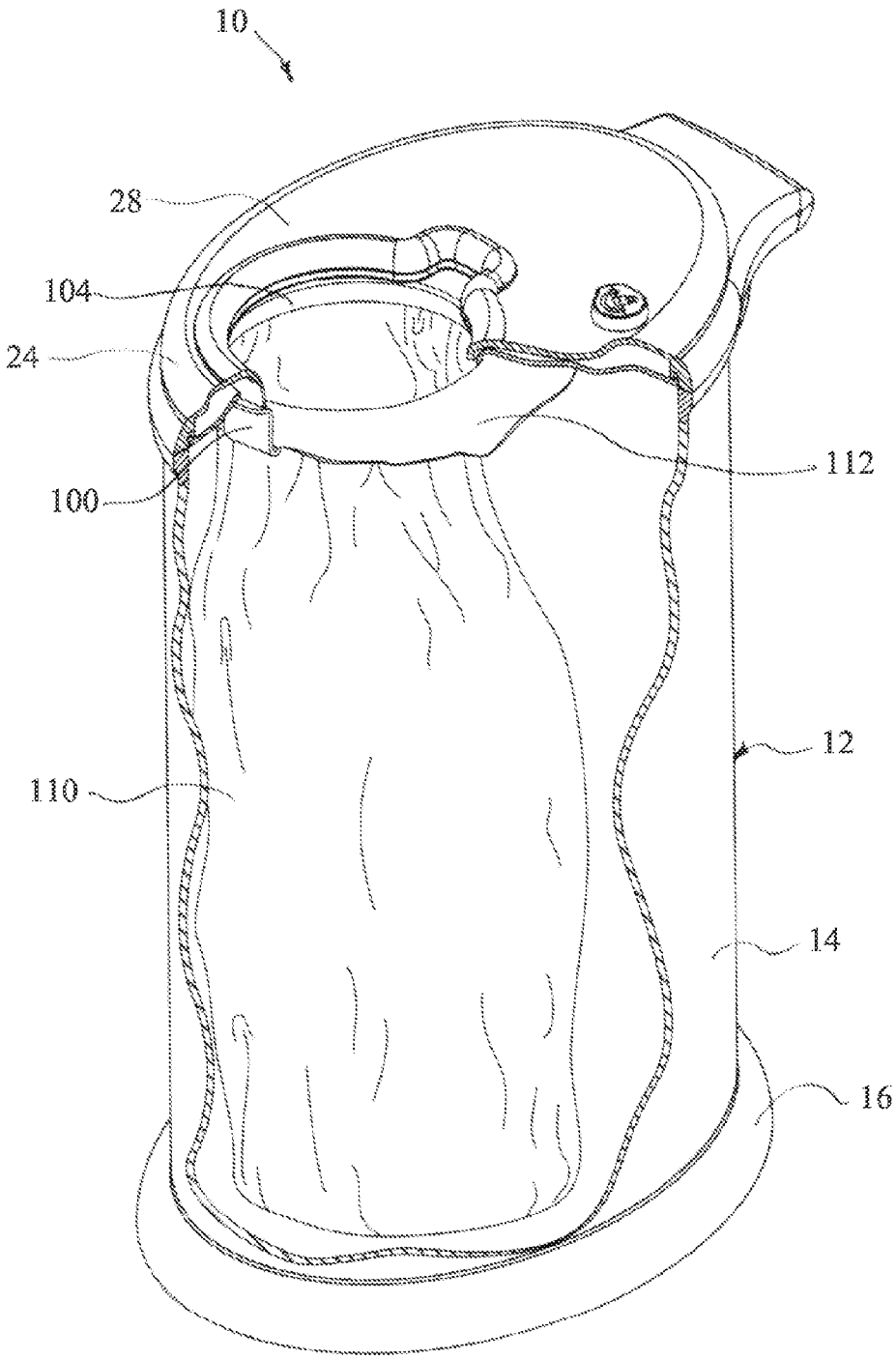
FIG. 12 is a front perspective, cutaway view of the waste container of FIG. 1 with the lid closed and a bag inserted into the waste container.

Turning to FIGS. 11 and 12, the manner of using the waste container 10 will be described. The waste container 10 is designed for use with a bag to line the canister 12, such as a disposable trash bag or reusable bag, so this description will describe use with a bag. Obviously, the waste container 10 can be used without a bag, and such use is basically the same as described herein except that the waste products inserted into the container 10 will be stored directly in the canister 12, and then removed directly from the canister 12.

In order to install a trash bag (or reusable bag, as the case may be), the lid assembly 24 and retainer 30 are placed in their raised positions out of the way of the opening 18 in the canister 12. The trash bag 110 is then placed through the aperture 98 in the retainer frame 20 with the upper edge 112 of the trash bag folded over the top of the retainer frame 20 and the lower part of the trash bag loosely within the storage space of the canister 12. The trash bag 110 can be inserted by pushing the bottom of the bag through the aperture 98, or by lifting the retainer frame 20 and inserting the upper edge 112 of the bag 110 up through the aperture 98. A part of the upper edge of the trash bag 110 is inserted into the retainer clip/handle 100 to help secure the bag 110.

The lid assembly 24 and retainer 30 are then lowered into the closed and lowered position, respectively, as shown in FIG. 12. In this position, the rim 104 of the retainer 30 inserts into the aperture 98 of the retainer frame 20 and compresses the upper edge 112 of the trash bag 110 between the rim 104 and the ring portion 99 of the retainer frame 20, thereby retaining the trash bag 110. In order to dispose of a waste product into the waste container 10, the sliding door 50 is slid to the open position. The waste product is inserted through the hole 64 in the cover 46 and then the waste product falls, or is pushed, through the aperture 98 of the retainer frame 20 into the trash bag 110 within the storage space. The sliding door 50 is slid back to the closed position as shown in FIG. 12, thereby sealing the storage space.

When the trash bag 110 is full or otherwise needs to be disposed, the lid assembly 24 and the retainer 30 are pivoted to their open/raised positions out of the way of the opening 18 in the canister 12. This releases the upper edge 112 of the trash bag 110 from between the rim 104 and the ring portion 99 of the retainer frame 20. The retainer frame 20 is pivoted to its raised position out of the way of the opening 18. The upper edge 112 of the bag 110 is pushed back through the aperture 98. The trash bag 110 can then be removed, tied closed, and disposed. The waste container 10 is now ready for the installation of a new trash bag 110.

Although particular embodiments have been shown and described, it is to be understood that the above discussion is not intended to limit the scope of these embodiments. While embodiments and variations of the many aspects of the invention have been disclosed and described herein, such disclosure is provided for purposes of explanation and illustration only. Thus, various changes and modifications may be made without departing from the scope of the claims. For example, the materials described may be substituted for other suitable materials, and the general shapes and relative sizes of the components of the invention may be modified. Accordingly, embodiments are intended to exemplify alternatives, modifications, and equivalents that may fall within the scope of the claims. The invention, therefore, should not be limited, except to the following claims, and their equivalents.

What is claimed is:

1. A waste container, comprising:

a canister defining a storage space and having an opening at an upper end and a bottom at a lower end;

a retainer frame having a ring portion having an aperture for inserting a trash bag through the aperture and folding an upper edge of the trash bag over the retainer frame, the retainer frame pivotally attached to the canister for allowing the retainer frame to pivot between a lowered position in which the retainer frame is positioned over the opening of the canister and a raised position in which the retainer frame is substantially out of the way of the opening of the canister;

a retainer having a rim that inserts into the aperture of the retainer frame, the rim configured to retain the upper edge of the trash bag between the rim and the ring portion, the retainer pivotally attached to the canister for allowing the retainer to pivot between a lowered position in which the rim is inserted into the aperture with the retainer frame in its lowered position, and a raised position in which the retainer is substantially out of the way of the opening of the canister, wherein the aperture of the retainer frame is substantially smaller than the opening of the canister;

a lid pivotally attached to the canister for allowing the lid to pivot between a closed position in which the lid covers the opening, and an open position in which the opening is accessible, the lid having a hole which aligns with the aperture of the retainer frame when the lid is closed and the retainer frame is in its lowered position; and a sliding door coupled to the lid, the sliding door being slidable between a closed position in which the sliding door covers the hole in the lid and an open position in which the hole is accessible to insert an item of waste through the opening.

2. The waste container of claim 1, further comprising an elastomeric seal around the hole in the lid which seals against the sliding door when the sliding door is in its closed position.

3. The waste container of claim 2, further comprising a plurality of magnets disposed in the lid which bias the sliding door against the seal.

4. The waste container of claim 2, wherein the lid includes opposing channels, the opposing channels having a first portion aligned substantially parallel to the plane of the opening which guide the sliding door to move in a first direction substantially parallel to a plane of the hole in the lid, and a second portion which extends in a direction toward the plane of the opening which guides the sliding door in a second direction, transverse to the first direction, away from and toward the seal.

5. The waste container of claim 1, wherein the retainer is fixedly attached to the lid such that the retainer pivots along with the lid.

6. The waste container of claim 1, wherein the rim is substantially in a shape of a truncated cone.

7. The waste container of claim 1, wherein the canister has an oval cross section.

8. The waste container of claim 1, wherein the canister has a substantially cylindrical shape.

9. The waste container of claim 1, wherein the sliding door slides substantially horizontally.

10. The waste container of claim 1, further comprising an elastomeric seal between the lid and the canister.

11. The waste container of claim 1, further comprising a locking device for locking the sliding door in its closed position.

12. The waste container of claim 1, further comprising a lid locking device for locking the lid in its closed position.

13. The waste container of claim 1, wherein the retainer frame comprises an arm portion connected to the ring portion, the arm portion is pivotally attached to the canister, and the ring portion has a retaining device for holding the trash bag.

14. The waste container of claim 13, wherein the retainer frame comprises a bag retainer clip disposed on an exterior surface of the retainer frame at an opposite end of the retainer frame from the pivotal attachment to the canister which bears against the canister to support the retainer frame in its closed position, the clip having a slot for receiving and retaining a trash bag and a handle for raising and lowering the retainer frame.

15. The waste container of claim 1, wherein the canister and sliding door are formed of a metal material.

16. The waste container of claim 1, wherein the lid is attached to the canister by a first hinge, wherein the hinge has a handle integrally formed therein.

17. The waste container of claim 1, wherein the retainer frame is attached to the canister by a second hinge.

18. The waste container of claim 16, wherein the retainer is attached to the canister by a second hinge.

19. The waste container of claim 18, wherein the second hinge utilizes at least part of the first hinge.

20. A waste container, comprising:

a canister defining a storage space and having an opening at an upper end and a bottom at a lower end;

a retainer frame having a ring portion having an aperture for inserting a trash bag through the aperture and folding an upper edge of the trash bag over the frame, the retainer frame movable from a lowered position in which the retainer frame is positioned over the opening of the canister and a raised position in which the retainer frame is substantially out of the way of the opening of the canister;

a retainer having a rim that inserts into the aperture of the retainer frame configured to retain the upper edge of the trash bag between the rim and the ring portion, the retainer being movable between a lowered position in which the rim is inserted into the aperture with the retainer frame in its lowered position, and a raised position in which the retainer is substantially out of the way of the opening of the canister;

wherein the aperture of the retainer frame is substantially smaller than the opening of the canister;

a removable lid for covering the opening in the canister, the lid being movable between a closed position in which the lid covers the opening, and an open position in which the opening is accessible, the lid having a hole which aligns with the aperture of the retainer frame when the lid is closed and the retainer frame is in its lowered position; and a sliding door coupled to the lid, the sliding door being slidable between a closed position in which the sliding door covers the hole in the lid and an open position in which the hole is accessible to insert an item of waste through the hole.

* * * * *